US011158239B2

(12) United States Patent
Kang et al.

(10) Patent No.: US 11,158,239 B2
(45) Date of Patent: Oct. 26, 2021

(54) DISPLAY DEVICE RECEIVING A CONTROL PATTERN THROUGH A VIDEO INTERFACE AND METHOD OF DRIVING THE SAME

(71) Applicant: SAMSUNG DISPLAY CO., LTD., Yongin-si (KR)

(72) Inventors: Bong Gyun Kang, Suwon-si (KR); Min Joo Lee, Yongin-si (KR); Myung Bo Sim, Chungcheongnam-do (KR); Shim Ho Yi, Seoul (KR); Sil Yi Bang, Hwaseong-si (KR); Won Bok Lee, Seongnam-si (KR); Jin Hyuk Jang, Hwaseong-si (KR); Chan Sung Jung, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 55 days.

(21) Appl. No.: 16/134,209

(22) Filed: Sep. 18, 2018

(65) Prior Publication Data

US 2019/0096316 A1 Mar. 28, 2019

(30) Foreign Application Priority Data

Sep. 22, 2017 (KR) ..... 10-2017-0122565

(51) Int. Cl.
*G09G 3/20* (2006.01)
*G09G 3/3233* (2016.01)
(Continued)

(52) U.S. Cl.
CPC ..... *G09G 3/2096* (2013.01); *G09G 3/3233* (2013.01); *G09G 3/3611* (2013.01); *G09G 5/006* (2013.01); *G09G 5/39* (2013.01); *G09G 3/3266* (2013.01); *G09G 3/3275* (2013.01); *G09G 3/3677* (2013.01); *G09G 3/3688* (2013.01);
(Continued)

(58) Field of Classification Search
CPC ..... G09G 2310/08; G09G 2320/045; G09G 2320/0626; G09G 2320/0693; G09G 2330/12; G09G 2340/02; G09G 2360/145; G09G 2370/08; G09G 2370/10; G09G 2370/12; G09G 3/2096; G09G 3/3233; G09G 3/3266; G09G 3/3275;
(Continued)

(56) References Cited

U.S. PATENT DOCUMENTS 6,213,879 B1 * 4/2001 Niizuma ..... H04L 7/0008 463/36
7,400,683 B2 * 7/2008 Linzer ..... H04N 19/423 375/240.25
(Continued)

FOREIGN PATENT DOCUMENTS

KR 1020150055324 5/2015

*Primary Examiner* — Ram A Mistry
(74) *Attorney, Agent, or Firm* — F. Chau & Associates, LLC

(57) ABSTRACT

A display device, comprising: a timing control unit receiving a video signal including a control pattern from outside and generating a characteristic control signal and image data based on the control pattern; and a display unit displaying an image based on the image data, wherein the control pattern includes a data pattern in which effective data is encoded, and the timing control unit decodes the data pattern to generate the characteristic control signal including the effective data.

21 Claims, 12 Drawing Sheets

(51) Int. Cl.

| | |
|---|---|
| ***G09G 5/39*** | (2006.01) |
| ***G09G 5/00*** | (2006.01) |
| ***G09G 3/36*** | (2006.01) |
| *G09G 3/3275* | (2016.01) |
| *G09G 3/3266* | (2016.01) |

(52) U.S. Cl.
CPC ... *G09G 2310/08* (2013.01); *G09G 2320/045* (2013.01); *G09G 2320/0626* (2013.01); *G09G 2320/0693* (2013.01); *G09G 2330/12* (2013.01); *G09G 2340/02* (2013.01); *G09G 2360/145* (2013.01); *G09G 2370/08* (2013.01); *G09G 2370/10* (2013.01); *G09G 2370/12* (2013.01)

(58) Field of Classification Search
CPC .. G09G 3/3611; G09G 3/3677; G09G 3/3688; G09G 5/006; G09G 5/39
See application file for complete search history.

(56) References Cited

U.S. PATENT DOCUMENTS

| | | | | |
|---|---|---|---|---|
| 9,473,731 | B2 * | 10/2016 | Kim | H04N 5/602 |
| 10,271,054 | B2 * | 4/2019 | Greenebaum | H04N 19/182 |
| 2015/0364114 | A1 * | 12/2015 | Smith | G09G 5/18 345/213 |

* cited by examiner

DISPLAY DEVICE RECEIVING A CONTROL PATTERN THROUGH A VIDEO INTERFACE AND METHOD OF DRIVING THE SAME

CROSS-REFERENCE TO RELATED APPLICATION

This application claims priority from Korean Patent Application No. 10-2017-0122565 filed on Sep. 22, 2017 in the Korean intellectual Property Office, and all the benefits accruing therefrom under 35 U.S.C. 119, the contents of which in its entirety are herein incorporated by reference.

TECHNICAL FIELD

The present invention relates to a display device and a method of driving the display device.

DISCUSSION OF RELATED ART

With the development of multimedia applications, various types of display devices such as a liquid crystal display (LCD) and an organic light emitting display (OLED) have been used.

Among display devices, a liquid crystal display device, which is one of the most widely used flat panel display devices, includes two substrates including electric field generating electrodes such as a pixel electrode and a common electrode and a liquid crystal layer disposed therebetween. In the liquid crystal display device, a voltage is applied to the electric field generating electrodes to form an electric field in the liquid crystal layer, so that the alignment of liquid crystal molecules in the liquid crystal layer is determined, and the polarization of incident light is controlled, thereby displaying an image.

Among display devices, an organic light emitting display device displays an image using an organic light emitting element that emits light by recombination of electrons and holes. The organic light emitting display device may have a high response speed, high luminance and a wide viewing angle. The organic light emitting display device is also capable of being driven at low power consumption.

SUMMARY

An aspect of the present invention is to provide a display device, which can receive data for controlling the operation characteristics of the display device through a video interface, and a method of driving the display device.

However, aspects of the present invention are not restricted to the one set forth herein. The above and other aspects of the present invention will become more apparent to one of ordinary skill in the art to which the present invention pertains by referencing the detailed description of the present invention given below.

An exemplary embodiment of the present invention discloses a display device, comprising: a timing control unit receiving a video signal from an external device and a display unit displaying an image. The video signal includes a control pattern that has a data pattern in which effective data is encoded. The timing control unit is operative to generate image data based on the control pattern and operative to decode the control pattern to generate a characteristic control signal including the effective data. The image displayed on the display unit is based on the image data.

An exemplary embodiment of the present invention also discloses an apparatus, comprising: a timing control unit receiving a video signal including a control pattern from external device through a video interface and generating a characteristic control signal and image data based on the control pattern. The control pattern may include a data pattern having effective pattern, and the timing control unit may extract the effective data from the data pattern, and generate the characteristic control signal including the extracted effective data. In an exemplary embodiment of the present invention, the apparatus may further include a display unit displaying a test image based on the image data.

An exemplary embodiment of the present invention discloses a method of driving a display device, comprising: receiving a video signal including a control pattern front external device through a video interface; generating a characteristic control signal and image data based on the control pattern; and wherein the control pattern includes a data pattern in which effective data is encoded, and the characteristic control signal includes the effective data extracted by decoding the data pattern. In an exemplary embodiment of the present invention, the method of driving the display device may further include displaying an image based on the image data.

BRIEF DESCRIPTION OF THE DRAWINGS

The above and other aspects and features of the present invention will become more apparent by describing in detail exemplary embodiments thereof with reference to the attached drawings, in which:

FIG. 3(*b*) is an equivalent circuit diagram illustrating the pixel shown in FIG. 2 which is implemented with a light emitting diode according to an exemplary embodiment of the present disclosure.

DETAILED DESCRIPTION OF THE EMBODIMENTS

Figure 1:
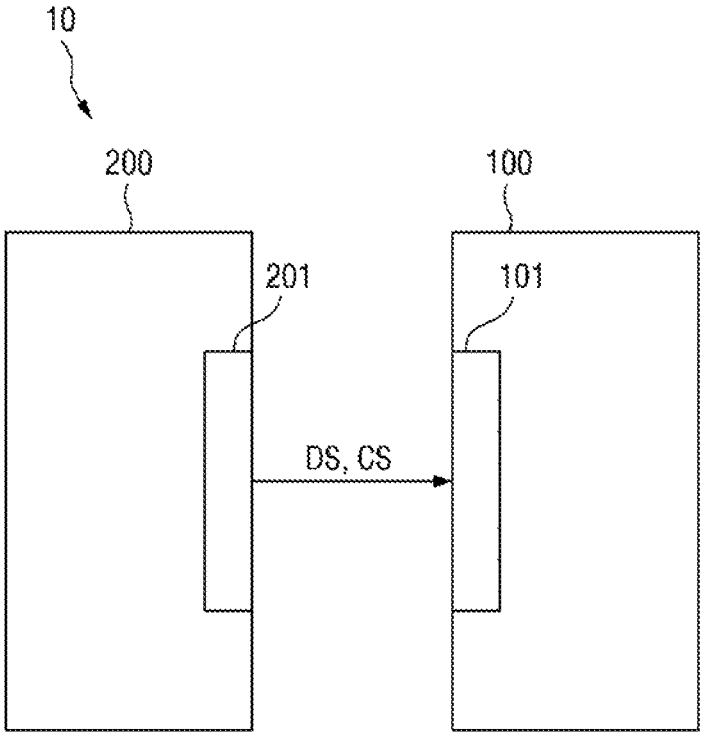
FIG. 1 is a block diagram illustrating a display interface system according to an exemplary embodiment of the present disclosure.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Hereinafter, embodiments of the present invention will be described with reference to the attached drawings.

FIG. 1 is a block diagram illustrating a display interface system according to an exemplary embodiment of the present disclosure.

Referring to FIG. 1, a display interface system 10 may include a display device 100 and a host 200.

The display device 100 may receive a video signal DS and a control signal CS. The display device 100 displays an image or controls operation characteristics using the video signal DS and the control signal CS. In an exemplary embodiment, the display device 100 may receive the video signal DS and the control signal CS from a second interface 201 of the host 200 through a first interface 101.

In an exemplary embodiment, the video signal DS may include gradation data for an image that is to be displayed by the display device 100 and a control pattern for controlling the operation characteristics of the display device 100. Accordingly, the images displayed by the display device 100 may be divided into a first image and a second image. The first image is defined as a general image that is displayed based on the gradation data. The second image is defined as a test image that is displayed based on the control pattern. Meanwhile, the control pattern may include a data pattern in which effective data is encoded. Details thereof will be described later with reference to FIGS. 5 to 10.

When the display device 100 receives the video signal DS including gradation data, the display device 100 displays the first image based on the gradation data. In contrast, when the display device receives the video signal DS including a control pattern, the display device 100 displays the second image based on the control pattern, and the operation characteristics of the display device 100 may be controlled based on the control pattern.

As described above, the control pattern serves to control the operation characteristics of the display device 100, and the video signal DS including the control pattern is defined as a signal arbitrarily provided for properly displaying an image on the display device 100. Meanwhile, in another exemplary embodiment, the display pattern may include both the gradation data and the control pattern. In this case, the display device 100 may display the first image on a first display area corresponding to the gradation data, and may display the second image on a second display area corresponding to the control pattern.

In FIG. 1, the first interface 101 and the second interface 201 are video interfaces. That is, the display device 100 may receive the control pattern for displaying the second image as well as the gradation data for displaying the first image through the video interfaces. The kind of the video interfaces is not particularly limited. Examples of the video interfaces may include a digital visual interface (DVI), a high definition multimedia interface (HDMI), a mobile industry processor interface (MIDI), and a display port.

The control signal CS may include a plurality of signals required for driving the display device 100. Examples of signals required for driving the display device 100 may include a horizontal synchronization signal (Hsync), a vertical synchronization signal (Vsync), a main clock signal, and a data enable signal.

In FIG. 1, the host 200 may provide the video signal DS and the control signal CS to the display device 100 through the second interface 201. The host 200 is not particularly limited as long as it can provide a signal to the display device 100 through a video interface. Examples of the host 200 may include a computer, a smart phone, a digital TV, a smart pad, a set top box (STB), a server, a graphic processor, and an application processor.

The video signal DS and the control signal CS will be described in more detail with reference to FIG. 2.

Figure 2:
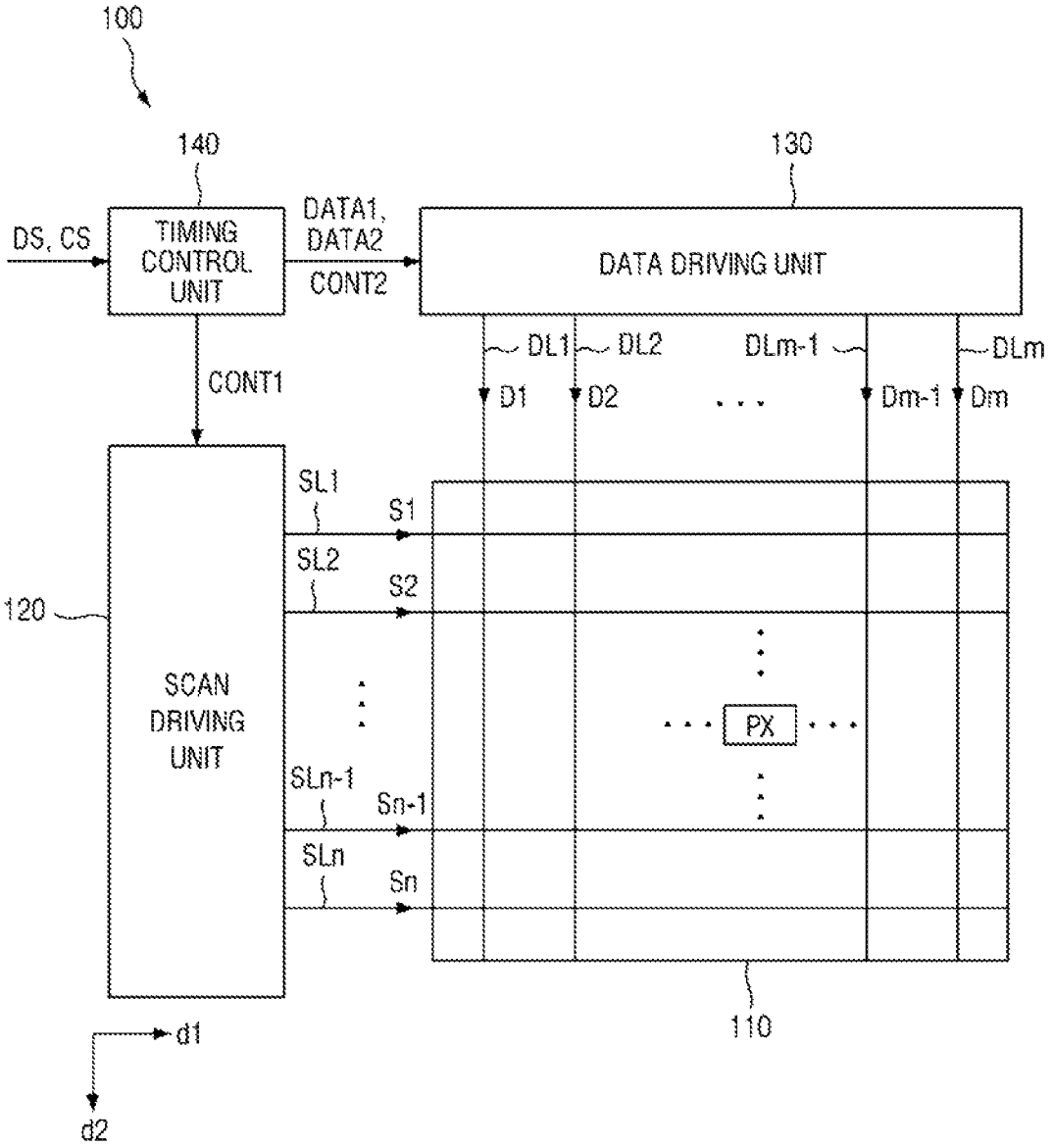
FIG. 2 is a block diagram illustrating the display device shown in FIG. 1 according to an exemplary embodiment of the present disclosure.

FIG. 2 is a block diagram illustrating an exemplary embodiment of the present disclosure of the display device shown in FIG. 1.

Referring to FIG. 2, the display device 100 may include a display unit 110 a scan driving unit 120, a data driving unit 130, and a timing control unit 140.

The display unit 110 is defined as a device that has a display area for displaying an image. The display unit 110 has a matrix of pixels PX. The matrix of pixels PX are electrically connected with 1st to nth scan lines (SL1 to SLn, where n is a natural number of 1 or more) extending in a first direction d1 and 1st to m-th data lines (DL1 to DLm, where in is a natural number of 1 or more) extending in a second direction d2. In an exemplary embodiment of the present disclosure, the first direction d1 is orthogonal to the second direction d2. Referring to FIG. 2, the first direction d1 is exemplified as a row direction, and the second direction d2 is exemplified as a column direction. The matrix of pixels PX may be arranged in the display area of the display unit 110 in a matrix that is defined by n scan lines (e.g., SL1 to SLn scan lines) and m data lines (e.g., DL1 to DLm data lines). In the matrix of pixels PX, air ij pixel (Pxij) is electrically connected with the i-th scan line (SLi, where i is a natural number of 1 or more) and the j-th data line (DLj, where j is a natural number of 1 or more). Exemplary embodiments of the ij pixel (Pxij) will be described with reference to FIG. 3(*a*) and FIG. 3(*b*).

Figure 3:
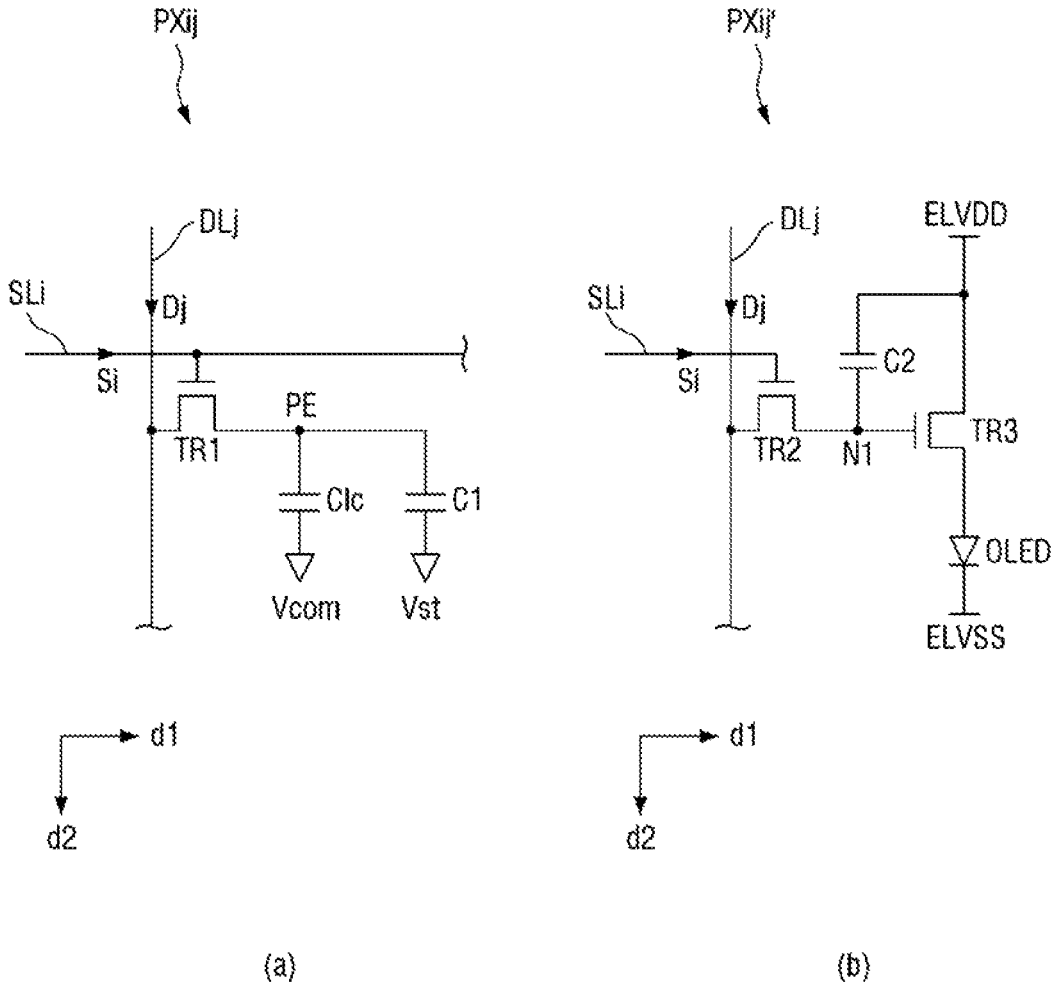
FIG. 3(*a*) is an equivalent circuit diagram illustrating the pixel shown in FIG. 2 which is implemented with a liquid crystal device according to an exemplary embodiment of the present disclosure.

Each of FIG. 3(*a*) and FIG. 3(*b*) is an equivalent circuit diagram that illustrates the ij pixel (Pxij) in the display area of the display unit 110 in FIG. 2 in accordance with some exemplary embodiments of the present disclosure.

First, referring to FIG. 3(*a*) as an exemplary embodiment of the present disclosure, the ij pixel PXij may include a switching element TR1, a pixel electrode PE, a liquid crystal capacitor C1*c*, and a first storage capacitor C1. When the display device 100 includes the ij pixel PXij shown in FIG. 3(*a*), the display device 100 may be characterized as a liquid crystal display device.

In FIG. 3(*a*), the first switching element TR1 may include a first control electrode electrically connected with the i-th scan line SLi extending in the first direction d1, a second electrode electrically connected with the j-th data line DLi extending in the second direction d2, and a third electrode electrically connected with the pixel electrode PE. Thus, in response to an i-th scan signal Si provided from the i-th scan line SLi, the first switching element TR1 may be turned on to provide to the pixel electrode PE a j-th data signal Dj from the j-th data line DLj.

In FIG. 3(*a*), the pixel electrode PE may be capacitively connected to a common electrode to which a common voltage Vcom is applied. That is, the liquid crystal capacitor C1*c* may be formed between the pixel electrode PE and the common electrode. In the first storage capacitor C1, one electrode is electrically connected with the pixel electrode PE, and another electrode is electrically connected with a storage electrode to which a storage voltage Vst is applied.

The components included in the pixel PXij and the connection relationship between the respective components are not limited to those shown in FIG. 3(*a*). For example, the ij pixel Pxij may further include a plurality of switching elements in addition to the first switching element TR1.

Another embodiment of the pixel Pxij will be described with reference to FIG. 3(*b*).

In FIG. 3(*b*), the pixel Pxij' may include a second switching element TR2, a third switching element TR3, a second storage capacitor Cst2, and an organic light emitting diode OLED. When the display device 100 includes the pixel PXij' shown in FIG. 3(*b*), the display device 100 may be characterized as an organic light emitting display device.

The second switching element TR2 may include a first control electrode electrically connected with the i-th scan line SLi extending in the first direction d1, a second electrode electrically connected with the j-th data line DLi extending in the second direction d2, and a third electrode electrically connected with a first node N1. Thus, in response to an i-th scan signal Si provided from the i-th scan line SLi, the second switching element TR2 may perform a switching operation to provide to the first node N1 a j-th data signal Dj from the j-th data line DLj. In one exemplary embodiment, the second switching element TR2 may be a switch transistor, such as a TFT transistor.

The third switching element TR3 may include a first control electrode electrically connected with the first node N1, a second electrode receiving a first driving voltage ELVDD, and a third electrode electrically connected with an organic light emitting diode OLED. In the exemplary embodiment as shown in FIG. 3(*b*), the first driving voltage ELVDD and the second driving voltage ELVSS are DC voltages, and the second driving voltage ELVSS has a voltage level that is lower than the first driving voltage ELVDD.

The third switching element TR3 may function as a driving transistor to control the amount of a driving current flowing into the organic light emitting diode OLED, based on the voltage applied to the first node N1 when the j-th data signal Dj from the j-th data line DLj is applied to the first node N1 through the semiconductor channel of the second switching element TR2 as the second switching element TR2 is turned on by the i-th scan signal Si provided from the i-th scan line SLi.

The second storage capacitor C2 may include one electrode electrically connected with the first node N1 and another electrode receiving the first driving voltage ELVDD. The second storage capacitor Cst2 may be charged to a storage voltage that is substantially identical to a voltage difference between the voltage applied to the first node N1 (from the j-th data line DLj through the semiconductor channel of the second switching element TR2) and the first driving voltage ELVDD.

The components included in the pixel Pxij' and the connection relationship between the respective components are not limited to those shown in FIG. 3(*b*). In another embodiment, the pixel Pxij' may further include a plurality of switching elements for compensating threshold voltage variations of the third switching element TR3 and/or compensating the deterioration of the organic light emitting diode OLED.

Referring to FIG. 2 again, the scan driving unit 120 may be electrically connected with the plurality of pixels PX through 1st to n-th scan lines (i.e., SL1 to SLn). In one embodiment, the scan driving unit 120 may generate 1st to nth scan signals (i.e., S1 to Sn) based on a scan control signal CONT1 provided from the timing control unit 140. The scan driving unit 120 may provide the generated 1st to n-th scan signals (i.e. S1 to Sn) to the plurality of pixels PX through the 1st to n-th scan lines (i.e., SL1 to SLn).

In an exemplary embodiment of the present disclosure, the scan driving unit 120 may include a plurality of switching elements that is operative to generate the 1st to n-th scan signals (i.e., S1 to Sn). In another embodiment, the scan driving unit 120 may include an integrated circuit that is operative to generate the 1st to n-th scan signals (i.e., S1 to Sn).

The data driving unit 130 may be electrically connected with the plurality of pixels PX through 1st to m-th data lines DL1 to DLm. In an exemplary embodiment, the data driving unit 130 may receive a data control signal CONT2 from the timing control unit 140. In some exemplary embodiments, the data driving unit 130 may also receive first image data DATA1 and/or second image data DATA2.

The data driving unit 130 may generate 1st to m-th data signals (i.e., D1 to Dm) based on the data control signal CONT2, the first image data DATA1 and/or the second image data DATA2. The data driving unit 130 may provide the generated 1st to m-th data signals (i.e., D1 to Dm) to the plurality of pixels PX through the 1st to m-th data lines (i.e., DL1 to DLm). In an exemplary embodiment of the present disclosure, the data driving unit 130 may include a shift register, a latch, a digital-analog conversion unit, and the like.

In FIG. 2, the timing control unit 140 may receive the video signal DS and the control signal CS from an external device. In one exemplary embodiment, the external device may be the host 200 as shown in FIG. 1. In some exemplary embodiments as described above, the video signal DS may include a gradation pattern and/or a control signal CS. The timing control unit 140 may process the video signal DS and the control signal CS to make them suitable for the operation conditions of the display unit 110 by generating image data (e.g., the first image data DATA1 and the second image data DATA2), the scan control signal CONT1, and the data control signal CONT2.

In one exemplary embodiment, the timing control unit 140 may convert gradation data included in the video signal DS into the first image data DATA1 and provide this first image data DATA1 to the data driving unit 130. In one exemplary embodiment, first image data DATA1 is obtained by converting the gradation data included in the video signal DS. In this exemplary embodiment, when the data driving unit 130 receives the first image data DATA1, a corresponding first image may be displayed by the display unit 110.

In one exemplary embodiment, when the video signal DS includes a control pattern, the timing control unit 140 may convert the control pattern included in the video signal DS into the second image data DATA2 and transmit this second image data DATA2 to the data driving unit 130. Here, the second image data DATA2 is obtained by converting the control pattern included in the video signal DS. In this exemplary embodiment, when the data driving unit 130 receives the second image data DATA2, a corresponding second image may be displayed by the display unit 110.

Hereinafter, the timing control unit 140 will be described in more detail with reference to FIG. 4.

Figure 4:
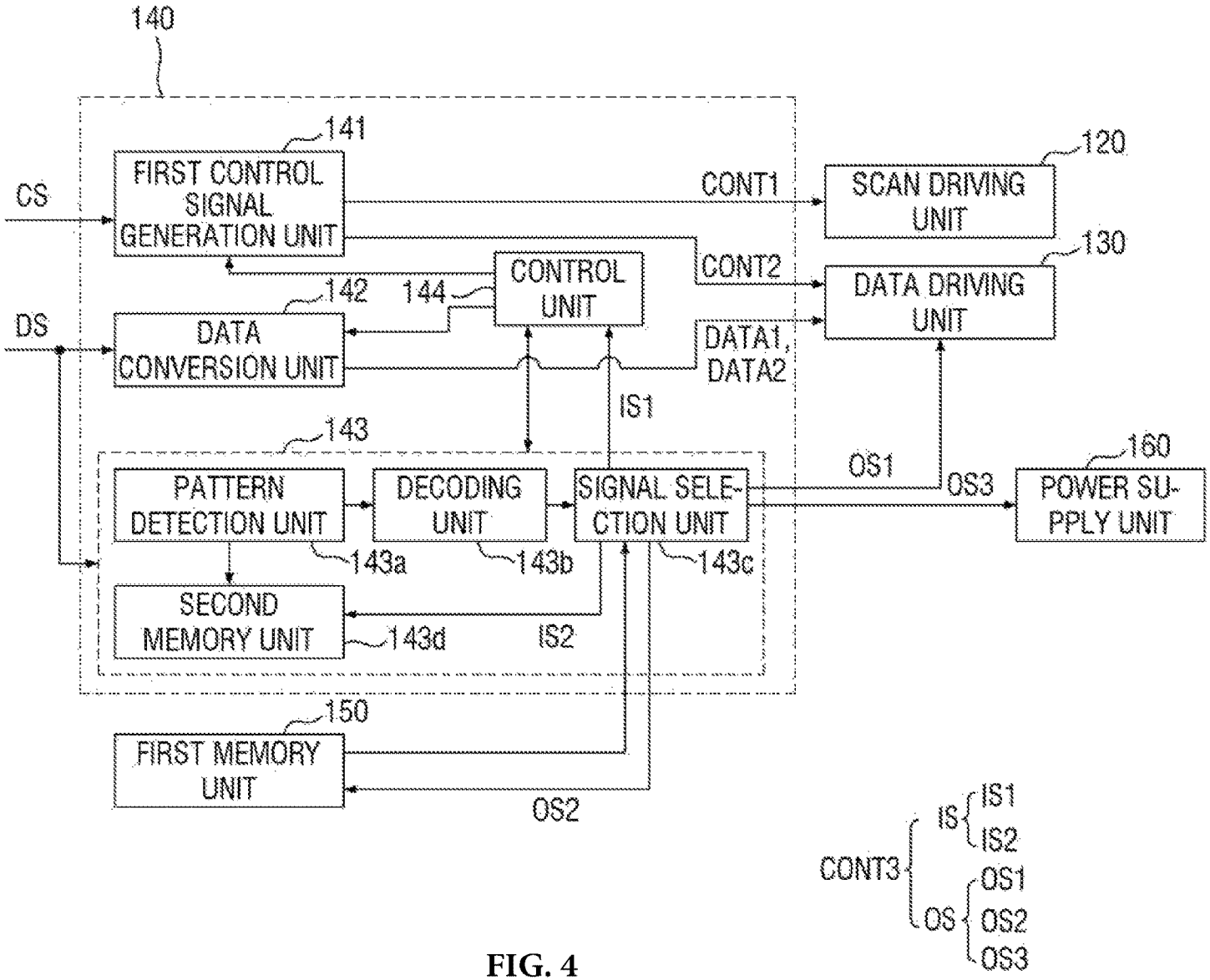
FIG. 4 is a block diagram more specifically illustrating the timing control unit shown in FIG. 2 according to an exemplary embodiment of the present disclosure.

FIG. 4 is a block diagram more specifically illustrating the time control unit 140 in FIG. 2 in accordance with some exemplary embodiments. The first memory unit 150 and power supply unit 160 is also shown in FIG. 4.

Referring to FIG. 4, the display device 100 in FIG. 2 may further include a scan driving unit 120 and a data driving unit 130.

In FIG. 4, the first memory unit 150 may provide stored data to the timing control unit 140 or may store data received from the timing control unit 140. In an exemplary embodiment of the present disclosure, the first memory unit 150 may store device information including the resolution, the driving frequency and timing information of the display device 100, the compensation data, and the like. In an exemplary embodiment of the present disclosure, the first memory unit 150 may include a special function register and/or a lookup table (LUT).

FIG. 4 shows a case where the first memory unit 150 is located outside the timing control unit 140, but the present invention is not limited thereto. In another embodiment, the first memory unit 150 may be included in the timing control unit 140.

The power supply unit 160 may supply a power to the display unit 110, the scan driving unit 120, the data driving unit 130, and the timing control unit 140. When the display device 100 is a liquid crystal display device, the power supply unit 160 may provide a common voltage Vcom (e.g., as shown in FIG. 3(*a*)) to the plurality of pixels PX disposed in the display unit 110. In contrast, when the display device 100 is an organic light emitting display device, the power supply unit 160 may provide a first driving voltage ELVDD (e.g., as shown in FIG. 3(*b*)) and a second driving voltage ELVSS (e.g., as shown in FIG. 3(*b*)) to the plurality of pixels PX disposed in the display unit 110.

Next, the timing control unit 140 will be described in more detail.

Referring to FIG. 4, the timing control unit 140 may include a first control signal generation unit 141, a data conversion unit 142, a second control signal generation unit 143, and a control unit 144.

The first control signal generation unit 141 may receive a control signal CS from an external device to generate a scan control signal CONT1 and a data control signal CONT2. The first control signal generation unit 141 may transmit the generated scan control signal CONT1 to the scan driving unit 120, and transmit the generated data control signal CONT2 to the data supply unit 300.

The control signal CS may include a plurality of signals required for driving the display device 100. Examples of the signals required for driving the display device 100 include a horizontal synchronization signal Hsync, a vertical synchronization signal Vsync, a main clock signal, and a data enable signal. The horizontal synchronization signal Hsync indicates the time taken to display one line of the display unit 110. The vertical synchronization signal Vsync indicates the time taken to display one frame of an image. The main clock signal is a signal used as a reference for generating various signals in synchronization with the scan driving unit 120 and the data driving unit 130, respectively, by the timing control unit 140.

The data conversion unit 142 may receive the video signal DS from the external device and generate image data. Here, the image data may be converted into first image data DATA1 when the video signal DS includes gradation data, and may be converted into second image data DATA2 when the display data DS includes a control pattern.

The data conversion unit 142 may transmit the generated first image data DATA1 and/or second image data DATA2 to the data driving unit 130. Since the data driving unit 130 cannot directly process the video signal DS provided from the external device, the data conversion unit 142 aligns and converts the video signal DS such that the data driving unit 130 can process the video signal DS, and supplies it to the data driving unit 130.

The second control signal generation unit 143 may be designed to detect a control pattern and to generate a characteristic control signal CONT3 based on the control pattern. The timing control unit 140 may control the operation characteristics of the display device 100 using the characteristic control signal CONT3. The second control signal generation unit 143 will be described later.

In FIG. 4, the control unit 144 controls the overall operation of the timing control unit 140. The control unit 144 may control the operations of the first control signal generation unit 141, the data conversion unit 142, and the second control signal generation unit 143 by transmitting and receiving various control signals. In an exemplary embodiment of the present disclosure, the control unit 144 may be a micro-control unit (MCU).

In other embodiments, the configuration of the timing control unit 140 is not limited to what have been described with reference to FIG. 4. The block diagram of the timing control unit 140 shown in FIG. 4 corresponds to some exemplary embodiments. In other embodiments, the timing control unit 140 may be configured such that some of the first control signal generation unit 141, the data conversion unit 142, the second control signal generation unit 143, and the first memory unit 150 are integrated with each other. In one exemplary embodiment, one component included in the timing control unit 140 may also perform the functions of other components as described previously with reference to FIG. 4.

The display device 100 according to an exemplary embodiment of the present disclosure may further include a third memory unit. In an exemplary embodiment of the present disclosure, the third memory unit may be a frame memory. When the third memory unit functions as a frame memory, it may store the first image data DATA1 and/or the second image data DATA2 of the previous frame in order to correct the first image data DATA1 and/or the second image data DATA2 of the current frame. In some embodiments, the third memory unit may also be omitted. In some embodiments, the third memory unit may be included in the timing control unit 140.

Hereinafter, the second control signal generation unit 143 will be described in more detail. In some embodiments, the second control signal generation unit 143 may include a pattern detection unit 143*a*, a decoding unit 143*b*, a signal selection unit 143*c*, and a second memory unit 143*d*.

In some embodiments, the pattern detection unit 143*a* may detect whether or not the control pattern is included in the video signal DS received from the external device. Here, when the control pattern is not included in the video signal DS, this means that gradation data is included in the video signal DS, and the display unit 110 generally displays a first image. In contrast, when the control pattern is included in the video signal DS, this means that the display unit 110 displays a second image, which is a test image, and the timing control unit 140 generates a characteristic control signal CONT3 for controlling the operation characteristics of the display device 100 based on the control pattern.

When the control pattern is not included in the video signal DS, the pattern detection unit 143*a* does not provide the received video signal DS to the decoding unit 143*b*. Therefore, the second control signal generation unit 143 does not generate the characteristic control signal CONT3 when the control pattern is not included in the video signal DS. The decoding unit 143*b* to be described later.

In contrast, when the control pattern is included in the video signal DS, the pattern detection unit 143*a* may transmit to the decoding unit 143*b* the video signal DS including the control pattern.

In an exemplary embodiment of the present disclosure, the pattern detection unit 143*a* may set a virtual search window area, and may confirm whether or not the control pattern exists in the video signal DS by searching whether or not the control pattern is provided in the search window area. Meanwhile, even when the control pattern exists in the video signal DS, if the control pattern is a pattern provided to an area other than the search window area set by the pattern detection unit 143*a*, the pattern detection unit 143*a* still determines that the control pattern does not exist in the video signal DS. In this case, the pattern detection unit 143*a* does not transmit to the decoding unit 143*b* the video signal DS. The method of detecting the control pattern using the search window area will be described in more detail with reference to FIGS. 5 to 10.

In some exemplary embodiments, regardless of whether the video signal DS includes the control pattern or the video signal DS does not include the control pattern, the pattern detection unit 143*a* may keep providing the video signal DS to the second memory unit 143*d*.

The decoding unit 143*b* may extract address data and effective data by decoding the control pattern included in the video signal DS that is transmitted from the pattern detection unit 143*a*. The decoding unit 143*b* then transmits to the signal selection unit 143*c* both the extracted address data and effective data.

The signal selection unit 143*c* may generate the characteristic control signal CONT3 based on the address data and effective data received from the decoding unit 143*b*. The signal selection unit 143*c* may transmit at least a part of the generated characteristic control signal CONT3 to one or more other component that can be either located inside the timing control unit 140 or outside the timing control unit 140. In an exemplary embodiment of the present disclosure, the characteristic control signal CONT3 may directly include the address data; in another embodiment, it may not include the address data. When the characteristic control signal CONT3 does not include the address data, the signal selection unit 143*c* may directly transmit the characteristic control signal CONT3 to a position corresponding to the address data.

In an exemplary embodiment of the present disclosure, the characteristic control signal CONT3 may include an internal control signal IS provided to a component included in the timing control unit 140 and/or an external control signal OS provided to a component located outside the tinting control unit 140.

In an exemplary embodiment of the present disclosure, the internal control signal IS may include a first internal control signal IS1 for transmitting to the control unit 144 and a second internal control signal IS2 for transmitting to the second memory unit 143*d*.

The control unit 144 may receive the first internal control signal IS1 to perform the optimization and tuning of the control unit 144 itself. In an exemplary embodiment of the present disclosure, the second memory unit 143*d* may receive the second internal control signal IS2 to change the data value stored in the second memory unit 143*d* or perform the optimization or tuning of the second memory unit 143*d*.

In other exemplary embodiments, the first memory unit 150 does not have to be located outside the timing control unit 140. For example, the first memory unit 150 may be included in the timing control unit 140, and the internal control signal IS may further include an internal control signal for transmitting to the first memory unit 150.

In an exemplary embodiment of the present disclosure, the external control signal OS may include a first external control signal OS1 for transmitting to the data driving unit 130, a second external control signal OS2 for transmitting to the first memory unit 150, and a third external control signal OS3 for transmitting to the power supply unit 160. In some embodiments of the present disclosure, the characteristic control signal CONT3 may include an external control signal OS; consequently, each of the first external control signal OS1, the second external control signal OS2, and the third external control signal OS3 may constitute a part of the characteristic control signal CONT3.

The data driving unit 130 may receive the first external control signal OS1 to change the setting of the data driving unit 130 itself. In an exemplary embodiment of the present disclosure, the first memory unit 150 may receive the second external control signal OS2 to change the data value stored in the first memory unit 150 or perform the optimization or tuning of the first memory unit 150. Further, in another exemplary embodiment, the first memory unit 150 may receive the second external control signal OS2 to test the display quality of the display device 100 or adjust the response speed and luminance balance of the display device 100. The power supply unit 160 may receive the third external control signal OS3 to change the setting of the power supply unit 160 itself or change the voltage level of the power output from the power supply unit 160.

Each of the internal control signal IS and the external control signal OS corresponds to an exemplary signal in the characteristic control signal CONT3, but in some embodiments, the characteristic control signal CONT3 may include one or more signals other than the aforementioned internal control signal IS and external control signal OS. For example, when the timing control unit 140 further includes another component or it is desired to change data value for components other than the aforementioned components, one or more additional signals in the characteristic control signal CONT3 may also be provided for transmitting to the corresponding component.

Hereinafter, the process of generating the aforementioned second external control signal OS2 will be described in more detail with reference to FIGS. 5 to 10.

Figure 5:
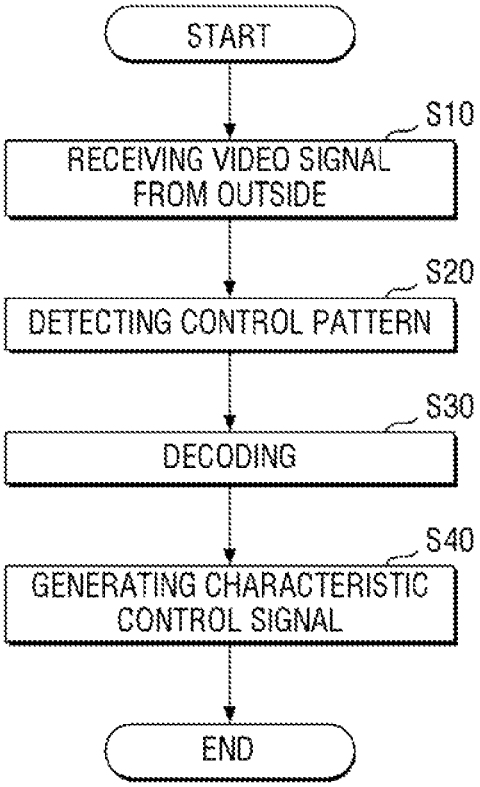
FIG. 5 is a flowchart illustrating a method of generating a characteristic control signal of a display device according to an exemplary embodiment of the present disclosure.
Figure 6:
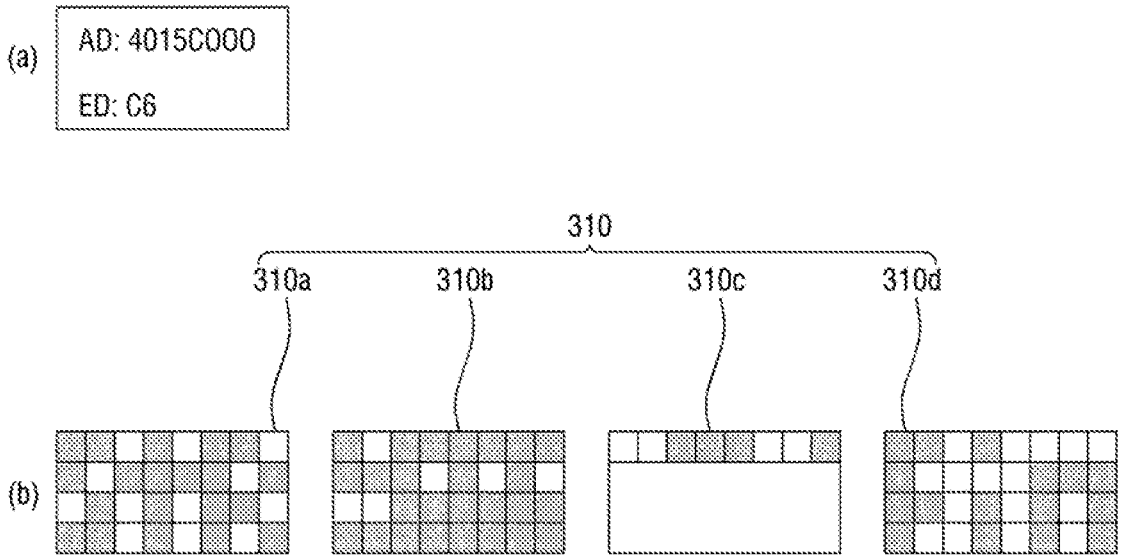
FIG. 6 is a schematic view for explaining a method of forming a control pattern by encoding effective data according to an exemplary embodiment of the present disclosure.

FIG. 5 is a flowchart illustrating a method of generating a Characteristic control signal of a display device according to an exemplary embodiment of the present disclosure. FIG. 6 is a schematic view for explaining a method of forming a control pattern by encoding effective data.

First, referring to FIGS. 4 to 6, the timing control unit 140 receives a video signal DS including a control pattern 310 from the external device (S10). As described above, the timing control unit 140 may receive through a video interface the video signal DS that includes the control pattern 310.

The control pattern 310 may include an address pattern 310*b* in which address data AD is encoded and a data pattern 310*c* in which effective data ED is encoded. The encoding process for the address pattern 310*b* and the data pattern 310*c* will be described in more detail in the following.

FIG. 6 is a schematic showing an example of data provided to the display device 100 in accordance with some embodiments. The address data AD may be position data that specifies the address in the first memory unit 150 to store the effective data ED. The address data AD and the effective data ED may be converted into an address pattern 310*b* and a data pattern 310*c* through encoding. The encoding method is not particularly limited. In an exemplary embodiment of the present disclosure, the encoding may be performed in a bit unit. In one exemplary embodiment, unlike that shown in FIG. 6, the positions of the address pattern 310*b* and the data pattern 310*c* may be mutually exchanged.

In the exemplary embodiment as shown in FIG. 6, the control pattern 310 may further include a start pattern 310*a* and an end pattern 310*d*. The start pattern 310*a* is a pattern in which start data is encoded, and the end pattern 310*d* is a pattern in which end data is encoded. That is, the start pattern 310*a* corresponds to a start mark, and the end pattern 310*d* corresponds to an end mark. Thus, the start pattern 310*a* and the end pattern 310*d* may be used to prevent the malfunction of pattern detection, because the second control signal generation unit 143 recognizes the address pattern 310*b* and the data pattern 310*c* located between the start pattern 310*a* corresponding to the start mark and the end pattern 310*d* corresponding to the end mark.

FIG. 6 shows an exemplary embodiment where the control pattern 310 has start, address, data, and end patterns 310*a* to 310*d*, but the present invention is not limited thereto. In other exemplary embodiment of the present invention, the shape, the size and the like of the control pattern 310 are not limited to those shown in FIG. 6. In some embodiments, the shapes and the sizes of start pattern 310*a*, address pattern 310*b*, data pattern 310*c*, and end pattern 310*d* may be different from each other.

Figure 7:
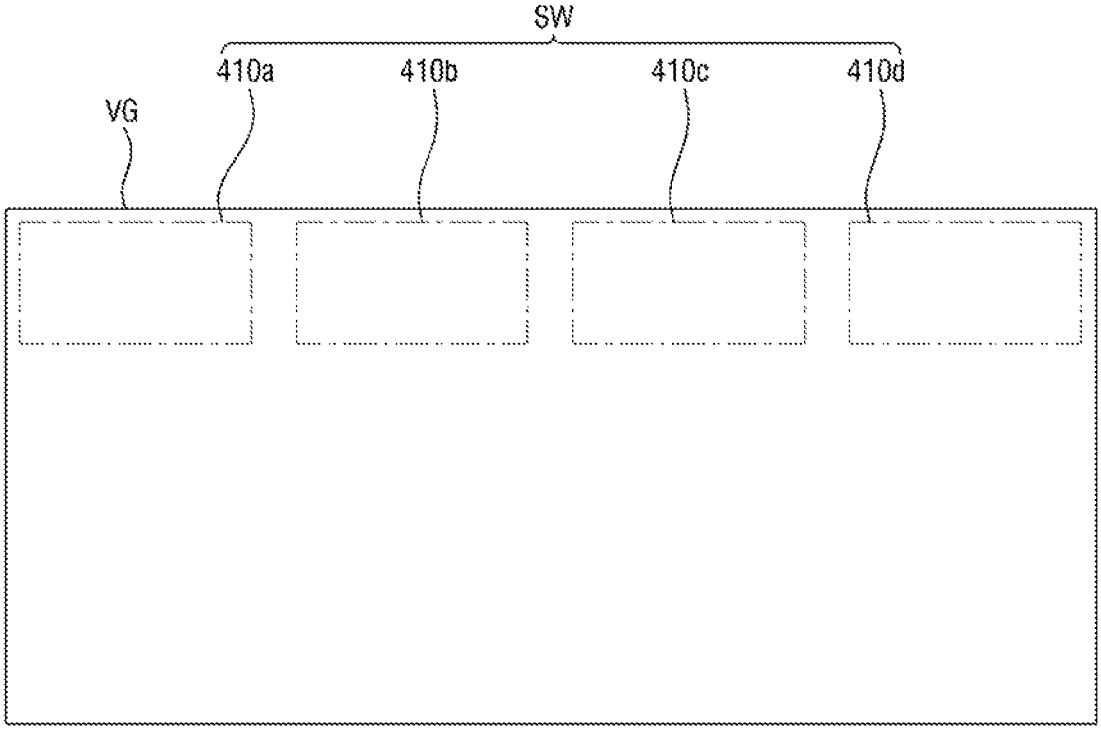
FIG. 7 is a schematic view for explaining a pattern detecting method of the pattern detection unit shown in FIG. 4 according to an exemplary embodiment of the present disclosure.

FIG. 7 is a view for explaining the pattern detection method of the pattern detection unit as shown in FIG. 4.

Referring to FIGS. 4, 5 and 7, the pattern detection unit 143*a* detects the control pattern 310 included in the video signal DS (S20). The pattern detection unit 143*a* may set a virtual search window area SW. The search window area SW may be disposed in a virtual display area VG. In one exemplary embodiment, the virtual display area VG may be the same as a display area in the display unit 110. Accordingly, the size and the shape of the virtual display area VG may be substantially the same as the size and the shape of the display area in the display unit 110.

In one exemplary embodiment, the pattern detection unit 143*a* may set a virtual display area VG which corresponds to the display area in the display unit 110. The search window area SW may be disposed in the virtual display area VG, and the control pattern 310 included in the video signal DS may be detected through the search window area SW. When the detected control pattern 310 is detected, the pattern detection unit 143*a* may transmit the detected control pattern 310 to the decoding unit 143*b* and the second memory unit 143*d*.

In an exemplary embodiment as shown in FIG. 7, the search window area SW may include first to fourth sub-search window areas 410*a* to 410*d*. The first to fourth sub-search window areas 410*a* to 410*d* may respectively correspond to the start, address, data, and end patterns 310*a* to 310*d* shown in FIG. 6. Accordingly, the sizes, the numbers and the shapes of the first to fourth sub-search window areas 410*a* to 410*d* may correspond to the sizes, the numbers, and the shapes of the start, address, data, and end patterns 310*a* to 310*d*, respectively.

In an exemplary embodiment of the present disclosure, the pattern detection unit 143*a* may set the sizes, the numbers and the shapes of the first to fourth sub-search window areas 410*a* to 410*d* based on the sizes, the numbers, and the shapes of the start, address, data, and end patterns 310*a* to 310*d*, respectively.

Figure 8:
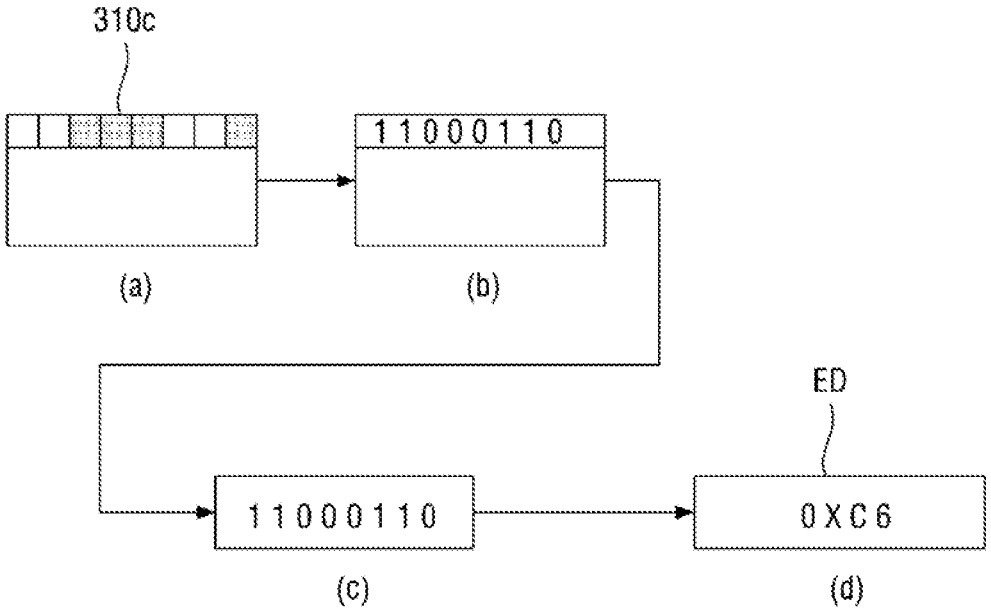
FIG. 8 is a schematic view for explaining a process of extracting effective data by decoding a control pattern including encoded effective data according to an exemplary embodiment of the present disclosure.

FIG. 8 is a schematic view for explaining a process of extracting effective data by decoding a control pattern that has the effective data encoded therein in accordance with some embodiments.

Referring to FIGS. 4 and 8, the decoding unit 143*b* decodes the control pattern 310 received from the pattern detection unit 143*a* (S30). The decoding unit 143*b* may extract the address data AD and the effective data ED by searching for the end data corresponding to the end mark. A process of extracting the effective data ED by decoding the third sub-control pattern 310*c* involves the following steps. First, binary conversion is performed on the third sub-control pattern 310*c*. Then, the effective data ED (0xC6) is extracted using the binary-converted result value (11000110).

After the extracted address data AD and the extracted effective data ED are transmitted from the decoding unit 143*b* to the signal selection unit 143*c*, the signal selection unit 143*c* may generate a second external control signal OS2 that has the effective data ED and the address data AD (S40). The signal selection unit 143*c* may further transmit the second external control signal OS2 to the first memory unit 150. The first memory unit 150 may replace the previous data located at the address specified by the address data AD with the effective data ED. Therefore, the timing control unit 140 may provide the effective data ED to the first memory unit 150 at address data AD. In some embodiments, the display device 100 may have the function of tuning the first memory unit 150 itself, optimizing the first memory unit 150, or adjusting the luminance balance of the display unit 110. In an exemplary embodiment of the present disclosure, the luminance balance of the display unit 110 may be controlled by adjusting image data or compensation data stored in the first memory unit 150. In another embodiment, the luminance balance of the display unit 110 may be adjusted using a luminance measuring meter 500 (refer to FIG. 10). Details thereof will be described later with reference to FIG. 10.

Meanwhile, in an exemplary embodiment of the present disclosure, the first memory unit 150 may perform correction to the effective data ED in a vertical blank section, which is a section in which no image is displayed in the first frame. Accordingly, the display device 100 may be operated by reflecting the effective data ED in the second frame subsequent to the first frame. However, the present invention is not limited thereto, and the first memory unit 150 may also perform correction to the effective data ED in a horizontal blank section. Further, the effective data (ED) may be reflected in a blank section of the third frame or the fourth frame in addition to the second frame subsequent to the first frame.

Figure 9:
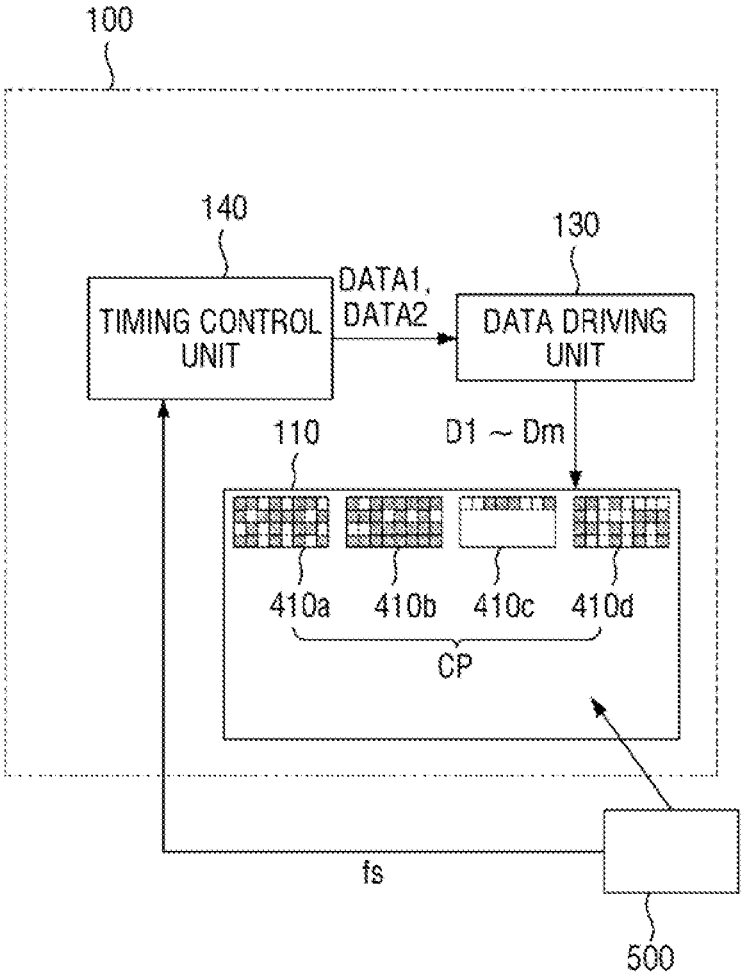
FIG. 9 is a schematic view illustrating a case where second image data corresponding to a control pattern is displayed in a display unit according to an exemplary embodiment of the present disclosure.

FIG. 9 is a schematic view illustrating a case where second image data corresponding to a control pattern is displayed in a display unit in accordance with some exemplary embodiments.

Referring to FIGS. 4 and 9, since the control pattern 310 included in the video signal DS is provided to the display device 100 through the video interface, the display unit 110 may display a display pattern CP corresponding to the control pattern 310 on a screen.

This will be described in more detail. The video signal DS having the control pattern 310 is provided to the data conversion unit 142 and converted into the second image data DATA2. The data conversion unit 142 provides the second image data DATA2 to the data driving unit 130. The data driving unit 130 provides a data signal corresponding to the second image data DATA2 to the display unit 110. The display unit 110 displays a second image having a display pattern CP, that is, a test image, based on the data signal.

That is, the display device 100 according to an exemplary embodiment of the present disclosure may receive the control pattern 310 included in the video signal DS through the video interface without using a communication board and a connection cable for connecting the timing control unit 140 and the external host 200 (refer to FIG. 1). Accordingly, the data transmission and reception method between the timing control unit 140 and the host 200 can be simplified, and user convenience can be provided.

Figure 10:
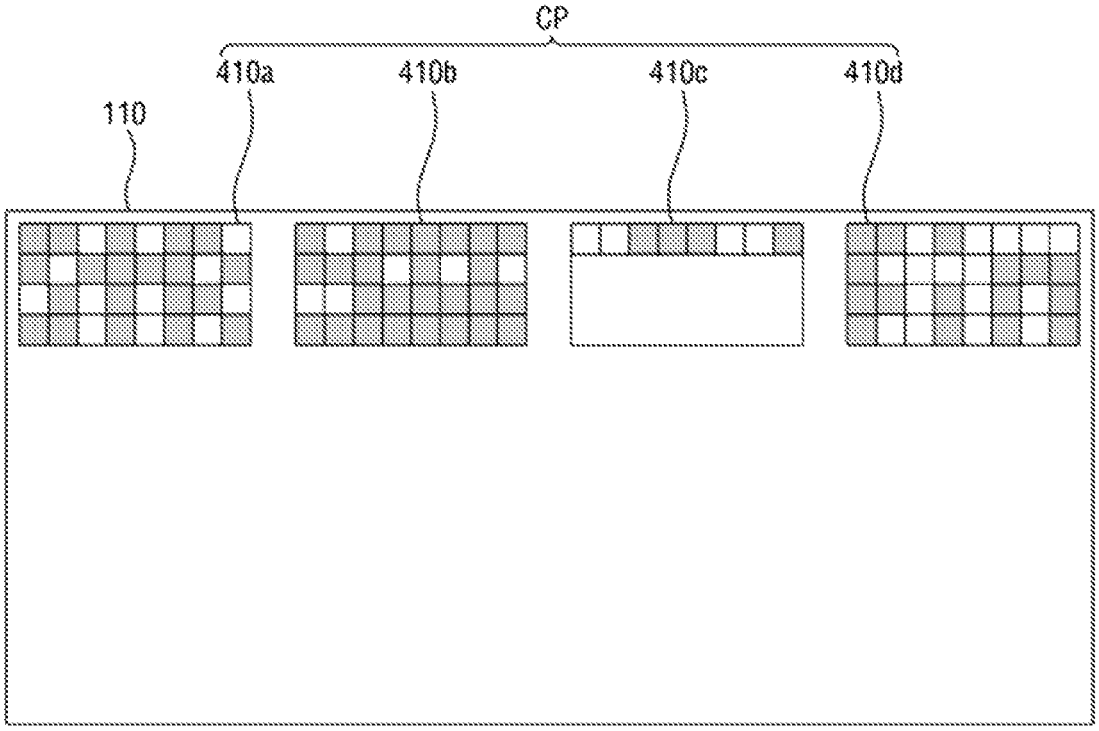
FIG. 10 is a schematic view for explaining the contents of controlling the luminance of a display unit using a luminance measuring meter, based on effective data included in a control pattern according to an exemplary embodiment of the present disclosure.

FIG. 10 is a schematic view for explaining the contents of controlling the luminance of a display unit using a luminance measuring meter, based on effective data included in a control pattern, in accordance with some exemplary embodiments.

Referring to FIGS. 4 and 10, as described above, the timing control unit 140 may receive the video signal DS including the control pattern 310, and may provide the second image data DATA2 to the data driving unit 130. The data driving unit 130 may generate 1st to m-th data signals D1 to Dm based on the second image data DATA2 and provide the 1st to the m-th data signals D1 to Dm to the display unit 110.

The display unit 110 displays a display pattern CP corresponding to the control pattern 310 on the screen. The luminance measuring meter 500 may measure the luminance of the display unit 110 by scanning the display pattern CP.

The luminance measuring meter 500 may provide the measured luminance of the display unit 110 to the timing control unit 140 through a feedback signal fs. The timing control unit 140 may correct the second image data DATA2 based on the feedback signal fs. For this purpose, the timing control unit 140 may further include an image correction unit.

In another embodiment of present embodiments, the luminance measuring meter 500 may provide the measured luminance of display unit 110 to the host 200 through the feedback signal fs. The host 200 may newly correct the control pattern based on the received feedback signal fs, and provide the corrected control pattern to the display device 100 again through the video signal DS. The display device 100 may generate the characteristic control signal CONT3 based on the corrected control pattern, so as to control the characteristics of the display device 100. In an exemplary embodiment of the present disclosure, the luminance balance of the display unit 110 may be adjusted by changing the data stored in the first memory unit 150, FIG. 11 is a view showing another embodiment of the pattern detection method of the pattern detection unit shown in FIG. 4, in accordance with some embodiments.

Figure 11:
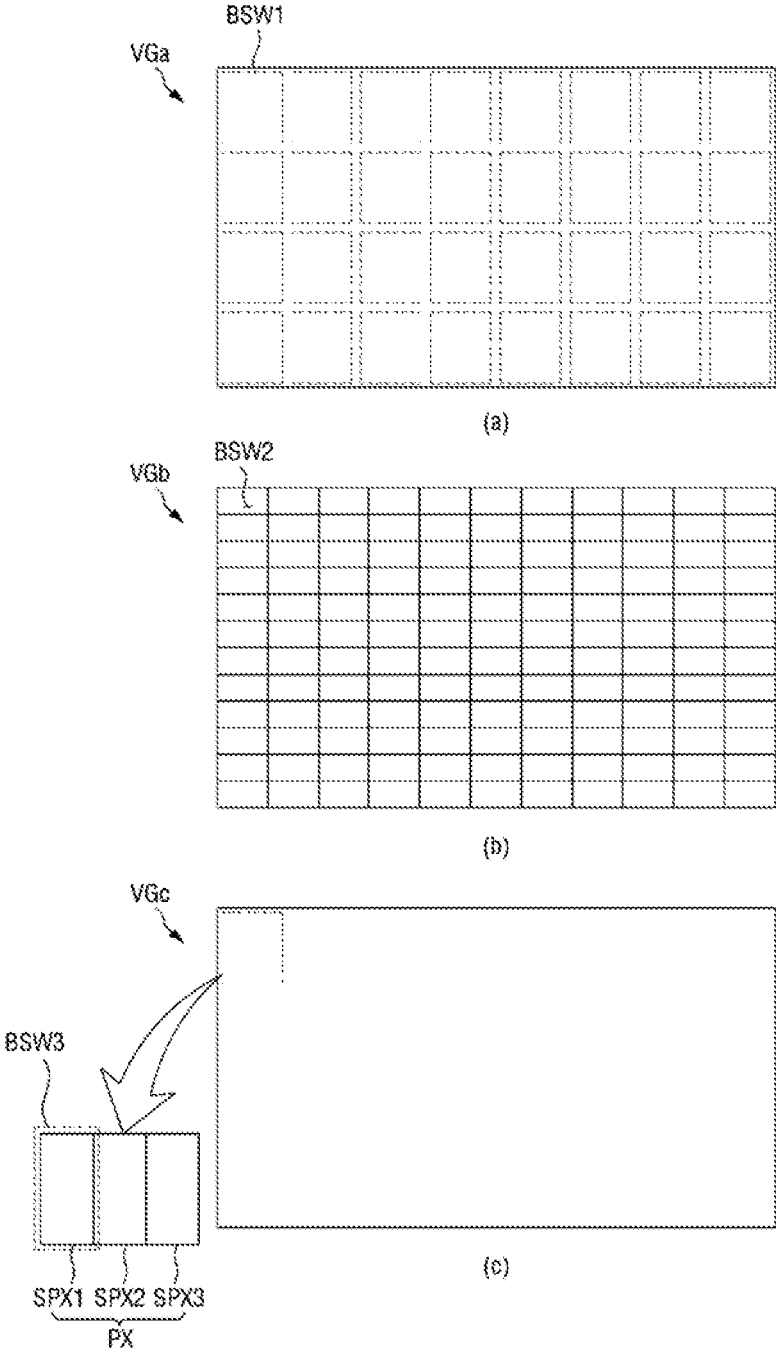
FIG. 11 is a schematic view illustrating another pattern detecting method of the pattern detection unit shown in FIG. 4 according to an exemplary embodiment of the present disclosure.

First, referring to FIG. 11(*a*), a unit search window area BSW1 disposed in a virtual display region VGa may be formed in a large size. That is, the size of the unit search window area BSW1 may be enlarged so as to correspond to an area including a plurality of pixels PX arranged in the display unit 110. The plurality of unit search window areas BSW1 may be formed. In this case, the number of the received data patterns may decrease, but stability against noise and the like can be secured.

Referring to FIG. 11(*b*), unit search window areas BSW2 may be arranged on a virtual display area. VGb so as to fill the entire virtual display area VGb. Further, the entire virtual display area VGb corresponding to the display unit 110 can be utilized as a search window area for detecting the control pattern 310 by decreasing the spacing distance between the unit search window areas BSW2.

Referring to FIG. 11(*c*), the size of a unit search window area. BSW3 disposed in the virtual display area VGc may be substantially the same as the size of the unit pixel SPX1 disposed in the display unit 110. Thus, the unit search window area BSW3 can be influenced by noise or the like, but the amount of the received data can be increased.

Figure 12:
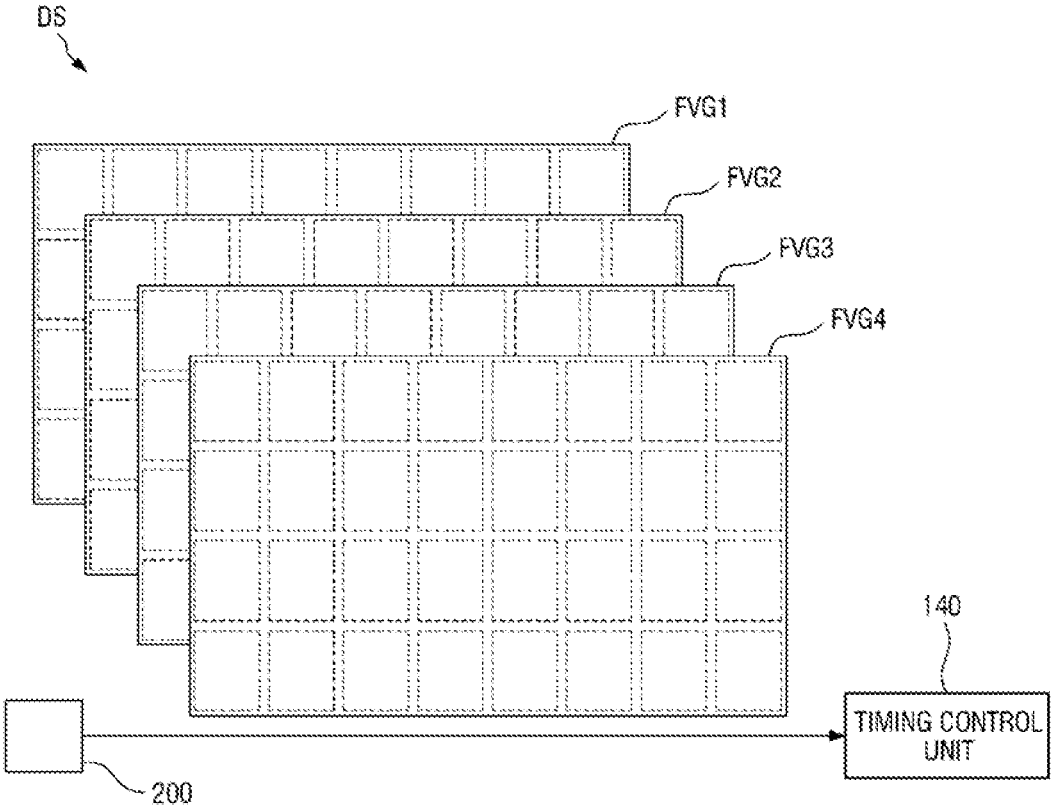
FIG. 12 is a schematic view illustrating another video signal receiving method shown in FIG. 1 according to an exemplary embodiment of the present disclosure according to an exemplary embodiment of the present disclosure.

FIG. 12 is a view illustrating another embodiment of the image signal receiving method shown in FIG. 1, in accordance with some embodiments.

Referring to FIG. 12, the host 200 may sequentially provide the video signal DS to the timing control unit 140 during a plurality of frames. In an exemplary embodiment of the present disclosure, when it is necessary to receive a large amount of data, such as a flash data write, the timing control unit 140 may sequentially receive the video signal DS having first to fourth control patterns FVG1 to FVG4 over the plurality of frames. The number of the plurality of frames is not particularly limited, and may vary depending on the capacity of data to be provided.

As described above, according to the embodiments of the present invention, data for controlling the operation characteristics of the display device can be received through a video interface.

Further, it can be shown that, in some exemplary embodiments, a communication board for connection with an external device is not required, and thus user convenience can be increased.

The effects of the present invention are not limited by the foregoing, and other various effects are anticipated herein.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A display device, comprising:

a display panel configured to display image data; and a timing control unit having a pattern detector, a decoder and a signal selector, wherein the timing control unit is configured to receive from an external device a video signal including a control signal and a data signal, wherein the pattern detector is configured to detect whether the data signal includes a control pattern in which effective data is encoded, wherein the decoder is configured to decode the detected control pattern into effective data, wherein the control pattern further includes an address at ern in which address data is encoded, wherein the decoder is configured to decode the detected control pattern into address data, wherein the signal selector is configured to generate a characteristic control signal based on the decoded effective data, wherein the characteristic control signal includes the decoded effective data, wherein the characteristic control signal further includes the decoded address data, wherein the timing control unit is operative to generate the image data based on the generated characteristic control signal.

2. The display device of claim 1, wherein the timing control unit receives the video signal including the control pattern from the external device through a video interface.

3. The display device of claim 2, wherein the video interface includes one of a digital visual interface (DVI), a high definition multimedia interface (HDMI), a mobile industry processor interface (MIPI), or a display port.

4. The display device of claim 1, wherein the control pattern includes a start pattern in which start data is encoded, an end pattern in which end data is encoded, and a data pattern located between the start pattern and the end pattern.

5. The display device of claim 1, further comprising:

a memory unit receiving at least a part of the characteristic control signal, wherein the timing control unit provides the effective data to the memory unit at an address corresponding to the address data.

6. The display device of claim 1, further comprising:

a power supply unit supplying a driving voltage to the display unit, wherein the power supply unit receives at least a part of the characteristic control signal and adjusts a voltage level of the driving voltage.

7. The display device of claim 1, wherein the timing control unit includes a data conversion unit converting the video signal including the control pattern into the image data.

8. The display device of claim 1, wherein the timing control unit sets a virtual display area in which a search window area is disposed, compares the search window area with an area on which an image corresponding to the control pattern is displayed, and detects the control pattern.

9. The display device of claim 1, wherein the characteristic control signal is indicative of at least one of resolution, driving frequency, timing information, or compensation data.

10. An apparatus, comprising:

a timing control unit receiving a video signal including a control pattern from an external device through a video interface and generating a characteristic control signal and image data based on the control pattern; and wherein the control pattern includes a data pattern having effective data, the timing control unit extracts the effective data from the data pattern, and generates the characteristic control signal including the extracted effective data, and the timing control unit sets a virtual display area in which a search window area is disposed, compares the search window area with an area on which an image corresponding to the control pattern is displayed, and detects the control pattern.

11. The apparatus of claim 10, wherein the video interface includes one of a digital visual interface (DVI), a high definition multimedia interface (HDMI), a mobile industry processor interface (MIPI), or a display port.

12. The apparatus of claim 10, wherein the timing control unit extracts the effective data by decoding the data pattern.

13. The apparatus of claim 10, further comprising:

a power supply unit supplying a driving voltage to a display unit of the apparatus, wherein the power supply unit receives at least a part of the characteristic control signal and adjusts a voltage level of the driving voltage.

14. The apparatus of claim 10, wherein the external device includes one of a computer, a smart phone, a digital TV, a smart pad, a set top box (STB), a server, a graphic processor, or an application processor.

15. The apparatus of claim 10, further comprising:

a display unit displaying a test image based on the image data.

16. A method of driving a display device, comprising:

receiving a video signal from an external device through a video interface; and generating a characteristic control signal and image data based on a control pattern when the video signal includes the control pattern, wherein the control pattern includes a data pattern in which effective data is encoded, and the characteristic control signal includes the effective data extracted by decoding the data pattern, and the characteristic control signal is not generated when the control pattern is not included in the video signal.

17. The method of driving a display device of claim 16, wherein the video interface includes one of a digital visual interface (DVI), a high definition multimedia interface (HDMI), a mobile industry processor interface (MIPI), or a display port.

18. The method of driving a display device of claim 16, wherein the external device includes a computer, a smart phone, a digital TV, a smart pad, a set top box (STB), a server, a graphic processor, and an application processor.

19. The method of driving a display device of claim 16, wherein the control pattern further includes an address pattern in which address data is encoded, and the method further includes providing the effective data to a memory unit at an address corresponding to the address data.

20. The method of driving a display device of claim 16, wherein the generating of the characteristic control signal includes: detecting the control pattern, decoding the data pattern, and generating the characteristic control signal having the effective data.

21. The method of driving a display device of claim 16, further comprising:

displaying an image based on the image data.

* * * * *